US006119756A

United States Patent [19]

Tatro

[11] Patent Number: 6,119,756

[45] Date of Patent: Sep. 19, 2000

[54] WINDOW BLIND INSERT

[75] Inventor: Michael J Tatro, Wausau, Wis.

[73] Assignee: Window Accessory Company Incorporated, Schofield, Wis.

[21] Appl. No.: 09/226,900

[22] Filed: Jan. 8, 1999

[51] Int. Cl.[7] ..... A47H 1/00

[52] U.S. Cl. ..... 160/107; 160/90; 160/381; 160/176.1; 49/64; 52/202

[58] Field of Search ..... 160/90, 107, 170.1 R, 160/176.1 R, 174, 187, 196; 49/87.1, 64, 380, 463

[56] References Cited

U.S. PATENT DOCUMENTS

| | | | |
|---|---|---|---|
| 336,944 | 3/1886 | Ransom . | |
| 920,423 | 5/1909 | Briggs . | |
| 1,203,634 | 11/1916 | Laudenschlager et al. . | |
| 1,582,111 | 4/1926 | Wogan . | |
| 1,871,557 | 8/1932 | Racy . | |
| 2,040,853 | 5/1936 | Kauffman et al. | 98/121 |
| 2,239,528 | 4/1941 | Knudsen | 20/56.5 |
| 2,311,300 | 2/1943 | Dubour et al. | 268/96 |
| 2,771,133 | 11/1956 | Haskell | 160/107 |
| 2,775,798 | 1/1957 | Bent | 160/90 |
| 2,813,311 | 11/1957 | Vaughn | 160/90 |
| 2,963,084 | 12/1960 | Daniels | 160/90 |
| 3,318,360 | 5/1967 | Persson | 160/107 |
| 4,274,469 | 6/1981 | Kuyper et al. | 160/107 |
| 4,602,456 | 7/1986 | Tatro | 49/75 |
| 4,877,076 | 10/1989 | Komori et al. | 160/107 |
| 4,884,613 | 12/1989 | Komori et al. | 160/107 |
| 4,913,231 | 4/1990 | Schnelker | 160/107 |
| 5,000,242 | 3/1991 | Coddens | 160/107 |
| 5,042,551 | 8/1991 | Ein et al. | 160/90 |
| 5,192,112 | 3/1993 | Gherardi et al. | 296/190 |
| 5,309,972 | 5/1994 | Thomas | 160/90 |
| 5,497,820 | 3/1996 | Drake, III | 160/107 |
| 5,575,115 | 11/1996 | Lindgren et al. | 160/107 X |

*Primary Examiner*—Daniel P. Stodola
*Assistant Examiner*—Bruce A. Lev
*Attorney, Agent, or Firm*—Quarles & Brady LLP

[57] ABSTRACT

A window insert suitable for insertion into a conventional window insert receptacle includes a frame and a blind assembly mounted to the frame. The frame defines an opening, and is adapted for insertion into the window insert receptacle. The blind assembly can include a plurality of slats which cover the opening.

11 Claims, 7 Drawing Sheets

WINDOW BLIND INSERT

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

The invention relates to window coverings. More particularly, it provides an easily installable blind for use with a conventional window.

Window blinds are a popular window treatment mounted to a window frame to provide added color to a room decorating scheme and to control the amount of light entering through the window panes. As shown in FIG. 1, a typical conventional window installed in a wall opening has a window frame 11, with a sill 13, opposed jambs (not shown), and a head member 15. The window frame 11 defines a window opening 17 which is closed by one or more panes 19 of glass set in a sash 21. The sash 21 is moveable from an open to a closed position allowing air to pass through the window opening 17.

The window frame 11 is typically adapted to form an insert receptacle 39 for receiving a screen insert 37. The screen insert prevents insects from passing through the window opening 17. Stops 41 or grooves formed in the frame 11 define the insert receptacle 39 slightly larger than the insert perimeter for easy insert 37 insertion and removal.

A blind 23 mounted to the window frame 11 controls light passing through the window opening 17. Typically, the blind 23 has a headrail 25 with a blind control mechanism 9 which angularly controls the tilt angle of slats 27 suspended from the headrail 25 in front of the window opening 17. A lift mechanism in the control mechanism 9 raises and lowers the slats 27. Light passing through the window opening 17 is controlled by lowering the slats 27 and tilting them to block the light.

The prior art blind 23, as shown in FIG. 1, is installed by mounting retaining clips 29 to the window frame 11, or trim attached thereto, and then slipping the blind headrail 25 into the clips 29. Mounting the clips 29 to the frame 11 requires measuring the length of the blind headrail 25 and transferring the measurements to the window frame 11. A drill is required to drill holes in the window frame 11 for screws 31 which secure the clips 29 to the frame 11. The clips 29 must be held in position while the screws 31 are threadably inserted into the frame 11 through the clip 29.

The clips 29 are generally located near the head member 15 and are typically in each upper corner of the window frame 11 making drilling and screwing difficult and awkward. Additionally, if the measurements are incorrect and the headrail 25 is too long or too short for the clip positions, one or more of the clips 29 must be unscrewed from the frame 11 and the process repeated, leaving unsightly holes in the window frame 11 as evidence of the first failed attempt to mount the blind 23.

Prior art blinds 23 also may interfere with existing window controls. The slats 27 or a bottom rail 33 of the blind 23 mounted to casement-type window often interfere with a window crank 35 extending from the window frame 11. The crank 35 operates a sash mechanism which opens and closes the sash 21 in the casement-type window. Slat interference with the crank 35 makes operating the sash mechanism difficult.

The prior art blind 23 may also impair access to the screen insert 37 disposed in the insert receptacle 39. Even when the downwardly depending slats 27 are fully retracted, they may block a portion of the window opening 17 and interfere with the removal or insertion of the screen insert 37. This makes cleaning the window panes 19 difficult.

One method which solves the installation and interference problems is to provide a window having a factory installed blind disposed between two panes of glass, such as described in U.S. Pat. No. 4,884,613. This particular method increases the cost of the window and requires complete replacement of existing windows if a blind is desired.

SUMMARY OF THE INVENTION

The present invention provides a window insert suitable for insertion into a conventional window insert receptacle. The insert has a frame defining an opening and is adapted for insertion into a window insert receptacle. A blind assembly mounted to the frame has a plurality of downwardly depending slats which cover the opening.

A general objective of the present invention is to provide a blind which is easily installable in a window frame. This objective is accomplished by providing a blind which can be inserted into an insert receptacle of a window.

Another objective of the present invention is to provide a blind which does not interfere with other window components. This objective is accomplished by providing a blind assembly mounted in a frame, wherein the blind assembly is disposed in a space defined by the insert receptacle and window pane.

Another objective of the present invention is to provide an insert frame on which a blind assembly can be mounted. This objective is accomplished by providing a window frame having frame members which include a mounting structure for mounting a blind assembly thereon.

Other objects and advantages of the invention will be apparent from the drawings and detailed description.

DETAILED DESCRIPTION OF THE PREFERRED EMBODIMENTS

Figure 1:
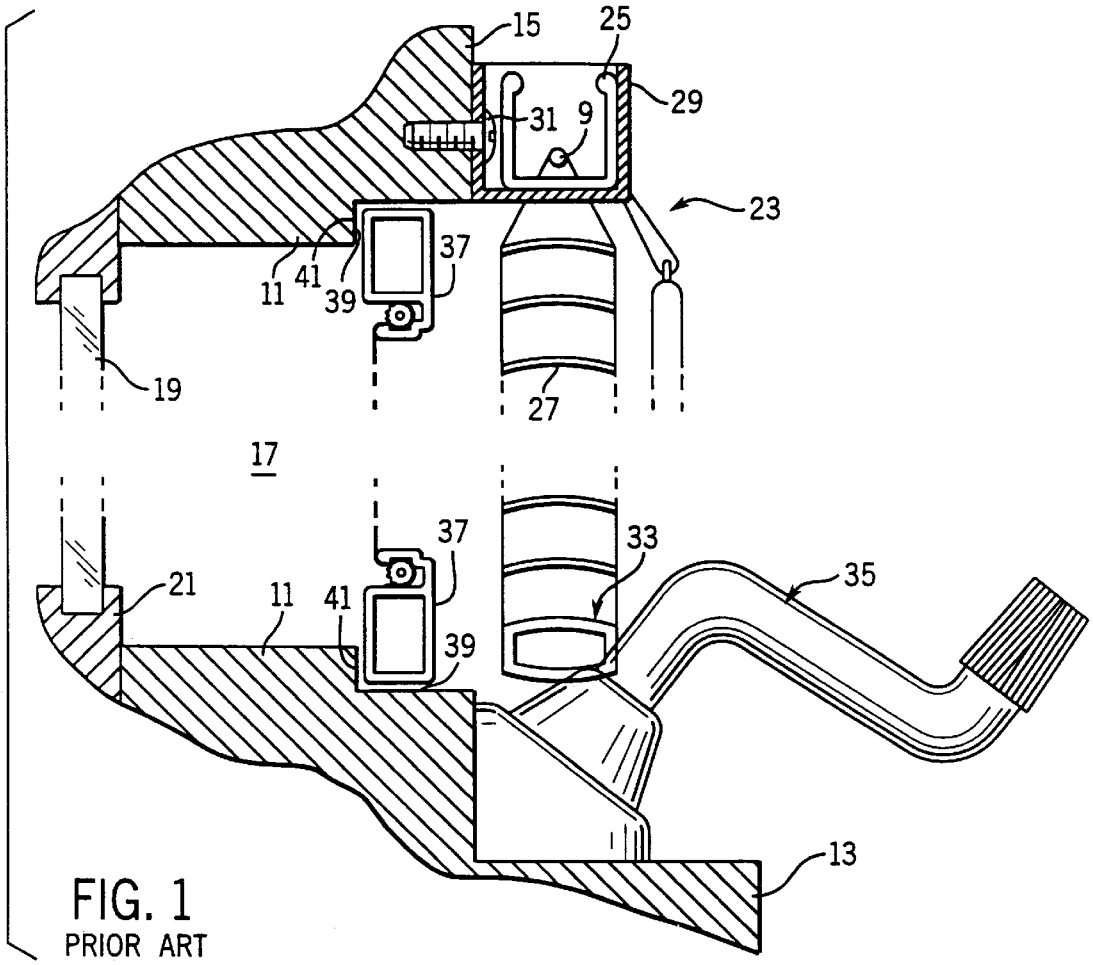
FIG. 1 PRIOR ART
FIG. 1 is a sectional view of a prior art blind and screen mounted in a window frame.

As shown in FIGS. 2–5, a blind insert 10 is disposed in an insert receptacle 12 of a conventional window unit. The window unit is installed in a wall opening and has a window frame 14, with a sill 16, opposed jambs 18, and a head member 20. The window frame 14 defines a window opening 22 which is closed by a one or more panes 24 of glass set in a sash 26. The sash 26 is moveable from an open to a closed position allowing air to pass through the window opening 22.

The insert receptacle 12, such as provided for a conventional screen insert, receives a blind insert 10 covering the window opening 22. The receptacle 12 has an outer perimeter 46 defined by the window frame 14 and has a face defined by stops 28 or grooves formed in the sill 16, jambs 18, and head member 20. Although, the insert receptacle 12 as described herein is defined by the stops 28 in the sill 16, jambs 18, and head member 20, the blind insert 10 may be adapted for use in insert receptacles 12 defined by stops or grooves in only portions of the window frame 14.

Figure 2:
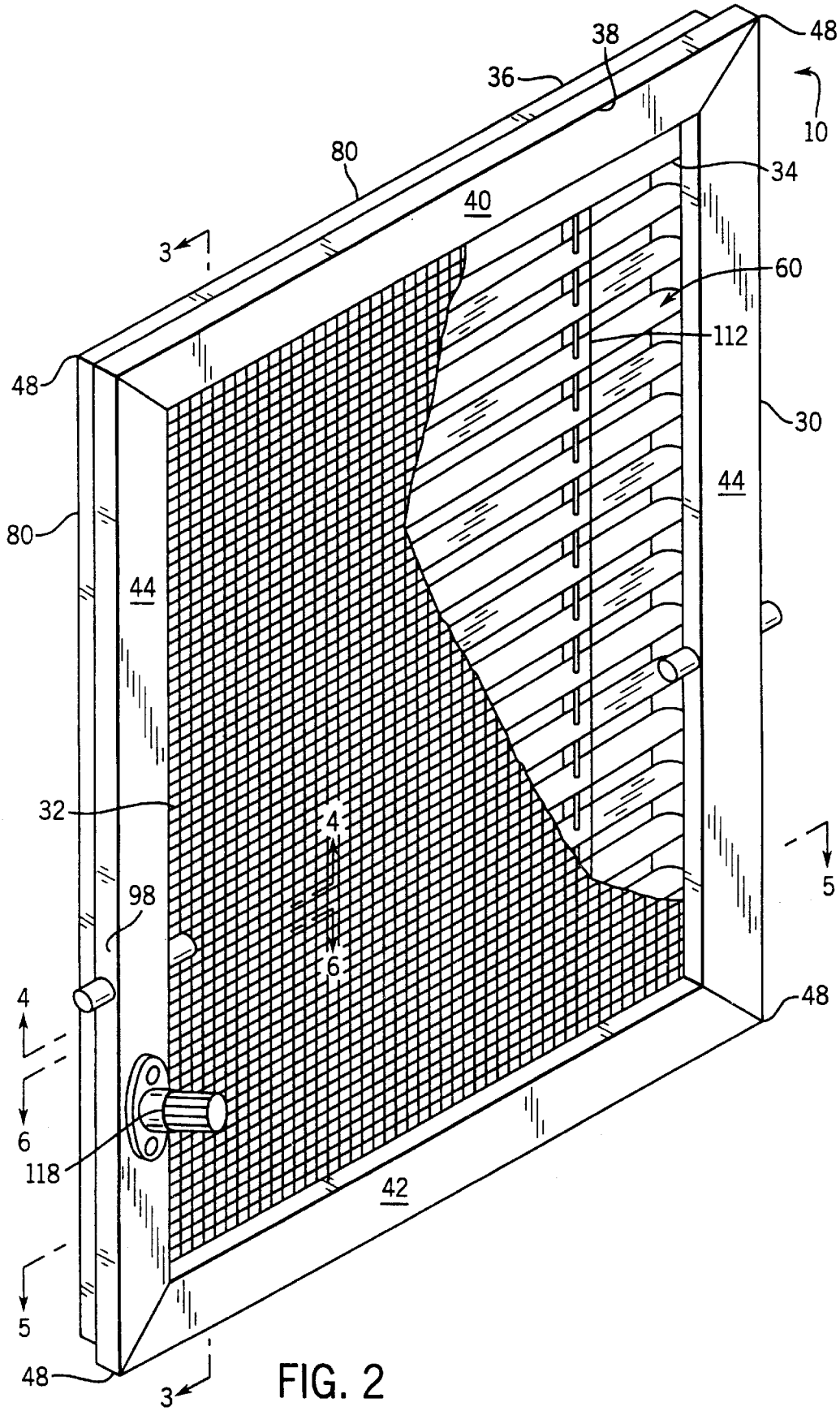
FIG. 2 is a perspective view of a blind insert incorporating the present invention.

The blind insert 10 is slightly smaller than the receptacle perimeter 46 and abuts the stops 28 when inserted into the receptacle 12. Referring to FIG. 2, the blind insert 10 has an insert frame 30 with a screen 32 and a blind assembly 34 mounted thereon. When installed in the insert receptacle 12, the insert 10 has a rear face 36 facing the window sash 26 and a front face 38 facing away from the sash 26. Releasable retaining members, such as pins 94, prevent the insert 10 from falling out of the receptacle 12.

The insert frame 30 defines a frame opening 60 and has a top member 40, bottom member 42, and two side members 44. The frame members 40, 42, and 44 are conventionally joined at frame corners 48. Preferably, each frame member 40, 42, 44 is formed from extruded aluminum, however, other materials, such as plastic, wood, or the like, may be used without departing from the scope of the present invention.

Figure 3:
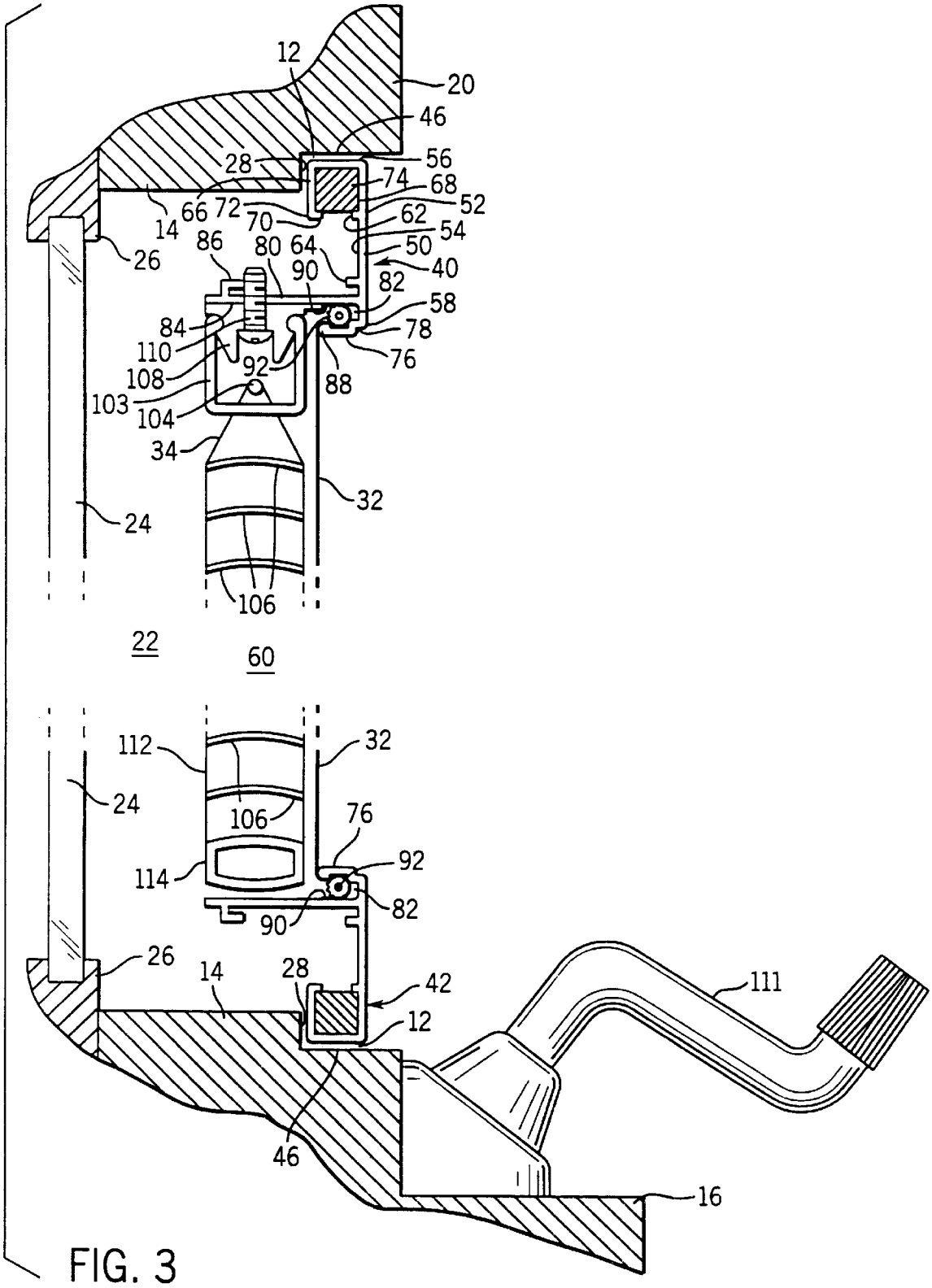
FIG. 3 is a sectional view along line 3—3 of the blind insert of FIG. 2 inserted in an insert receptacle.

Looking particularly at FIG. 3, the top frame member 40 has a face plate 50 with a front 52 defining the frame front face 38, a back 54, an outer edge 56 defining one side of a frame perimeter, and an inner edge 58 defining one side of the frame opening 60. Two ribs 62, 64 formed on the face plate back 54, along its length, stiffen the member 40.

The frame top member outer edge 56 is substantially perpendicular to a plane defined by the frame opening 60 and loosely engage the insert receptacle perimeter 46. A stop wall 66 extending inwardly (toward the frame opening 60) from the outer edge 56 abuts the receptacle stop 28. The outer edge 56, stop wall 66, and face plate back 54 form a U-shaped cavity 68 for receiving a corner key 74, such as a piece of aluminum, plastic or the like. The corner key 74 joins the frame top member 40 to an adjacent side member 44 forming one of the frame corners 48. A lip 70 extending forward from the stop wall end 72 cooperates with the rib 62 to retain the corner key 74 in the U-shaped cavity 68.

The top member inner edge 58 defines a top of the frame opening 60 and extends rearwardly (from the face plate back 54 away from the face plate front 52) from a step 78 formed in the face plate 50. The inner edge 58 cooperates with a mounting structure 80 disposed outwardly (away from the frame opening 60) from the inner wall 76 to form a spline slot 82 for mounting the screen 32.

The top frame mounting structure 80 has a mounting surface 84 and supports the blind assembly 34 mounted thereon. The structure 80 extends rearwardly from the face plate back 54 and is stiffened by an L-shaped rib 86 formed along its length. Preferably, the mounting structure 84 is formed as an integral part of the face plate 50 to provide a structural member having sufficient strength to support the blind assembly 34.

The mounting structure 80 extends past the inner wall rearward edge 88 a distance at least equal to the depth of blind assembly 34 to dispose the mounting surface 84 toward the window opening 22 between the insert receptacle 12 and window sash 26. Preferably the mounting surface 84 is substantially perpendicular to the plane defined by the frame opening 60 to provide a level surface for mounting the blind assembly 34 thereon.

The side and bottom frame members 42, 44 are substantially identical to the top frame member 40. By providing frame members 40, 42, 44 which are substantially identical, if the frame members 40, 42, 44 are formed by extrusion, they can be fabricated using a single die and are simply cut to the desired length. Advantageously, the mounting structure. 80 of the side and bottom frame members 42, 44 shields the window frame 14 and blind control components from view.

The screen 32 is conventionally secured to the insert frame 30 by forcing edges 90 of the screen 32 into the spline slot 82. A spline 92 forced into the spline slot 82 covered by the screen edges 90 provides a friction fit to retain the screen 32 in the frame opening 60.

The blind assembly 34 is mounted to the top frame mounting structure 80 and controls light passing through the frame opening 60. It has a conventional blind headrail 103 containing a conventional control mechanism 104 and a plurality of angularly adjustable horizontal slats 106 suspended from the blind headrail 103 containing control mechanism 104. The control mechanism 104 controls the light by pivoting each substantially parallel slat 106 about its longitudinal axis to allow or inhibit light from passing through the opening 60.

As best shown in FIG. 3, by attaching the blind headrail 103 to the mounting surface 84 extending into the window opening 22 between the insert receptacle 12 and window pane 24, the blind assembly 34 avoids interfering with window control components, such as a crank 111. The headrail 103 is preferably mounted to the mounting structure 80 by snapping onto clips 108 secured to the top frame mounting structure mounting surface 84. The clips 108 are secured to the mounting surface 84 by conventional methods, such as screws 110 or the like.

The plurality of slats 106 are suspended in the frame opening 60 from the control mechanism 104. Each slat 106 is substantially rectangular having a longitudinal axis and spans substantially the entire width of the frame opening 60. The slats 106 are horizontally suspended by two or more thread ladder assemblies 112, such as described in U.S. Pat. No. 5,497,820, which is incorporated herein by reference. Although horizontal slats 106 are disclosed herein, slats having other orientations, such as vertical slats, may be used without departing from the scope of the present invention.

Figure 5:
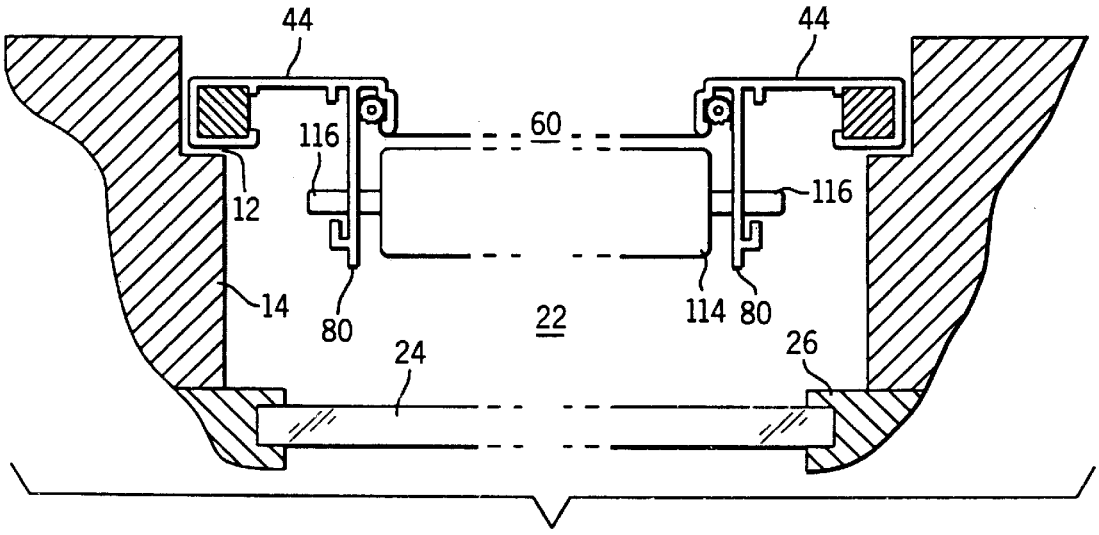
FIG. 5 is a sectional view along line 5—5 of the blind insert of FIG. 2 inserted in an insert receptacle.

As shown in FIGS. 3 and 5, a bottom rail 114 disposed in the bottom rung of the thread ladder assemblies 112 retains the slats 106 in the frame opening 60. The bottom rail 114 has outwardly extending pins 116 at each end which extend into the frame side member 44 mounting structures 80 and prevent the slats 106 and rail 114 from blowing in wind passing through the frame opening 60. Preferably, the pins 116 are spring biased to facilitate installation.

Figure 6:
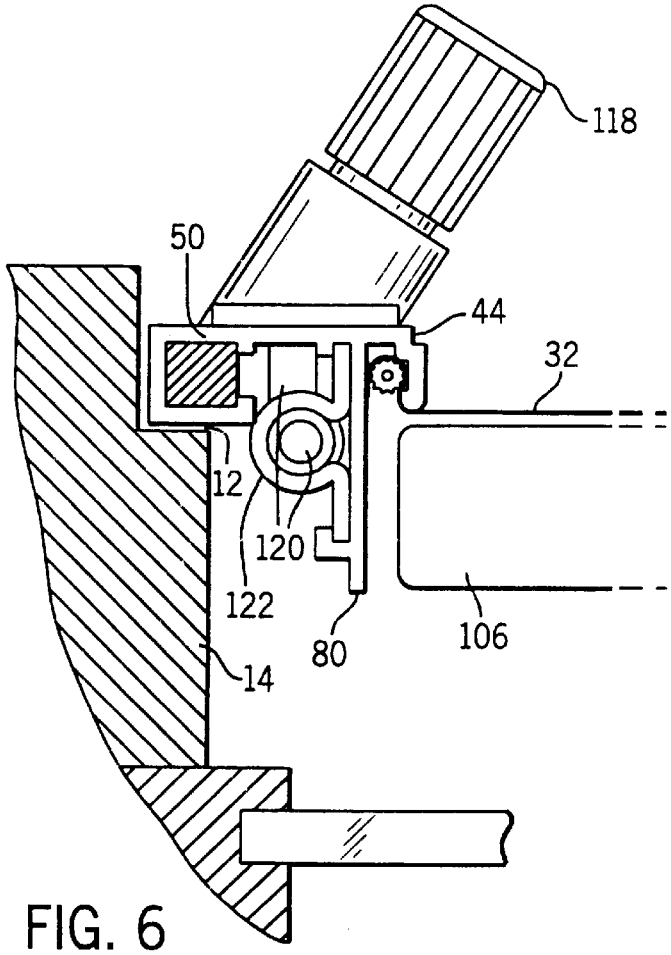
FIG. 6 is a sectional view along 6—6 of the blind insert of FIG. 2 inserted in an insert receptacle.

Referring to FIGS. 2 and 6, a blind control knob 118 mounted to the frame 30 front face 38 operates the blind control mechanism 104. The control knob 118 is operatively connected to the blind control mechanism 104 by a flexible shaft 120 disposed behind the frame member face plate 50. Brackets 122 mounted to the side frame mounting structure

80 hold the shaft 120 out of view from the user. Turning the control knob 118 rotates the shaft 120 to operate the control mechanism 104 and angularly adjust the slats 106. Advantageously, the control knob 118 is angled inwardly toward the frame opening 60 to avoid interference with the crank 111 and window frame 14.

Figure 4:
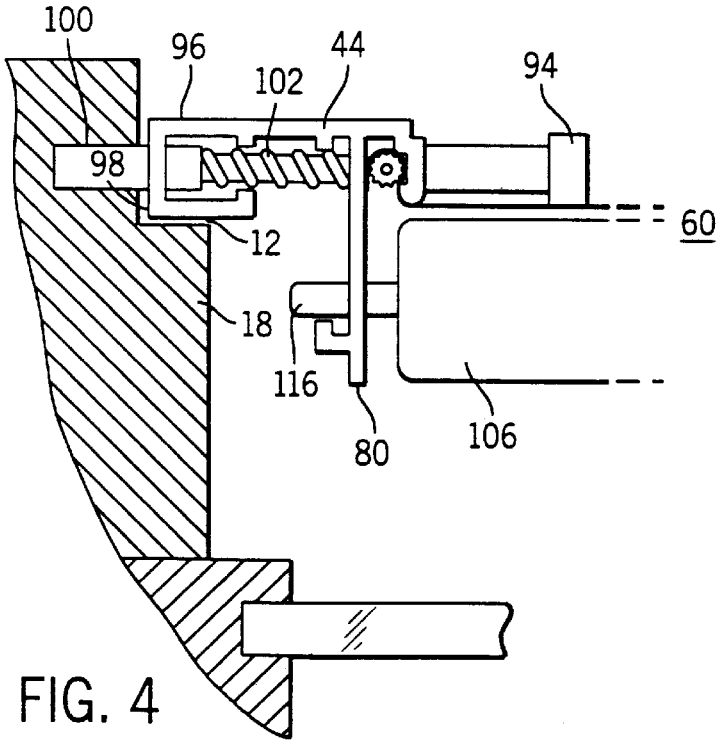
FIG. 4 is a sectional view along line 4—4 of the blind insert of FIG. 2 inserted in an insert receptacle.

Referring to FIGS. 2 and 4, spring biased pins 94 mounted in the insert frame side members 44 extend outwardly away from frame opening 60 through holes 96 formed in the side frame member outer edge 98. The pins 94 are received in cavities 100 formed in the window jambs 18 to hold the frame 30 in the receptacle 12. Springs 102 bias the pins 94 away from the frame opening 60 into the cavities 100 and releasably retain the insert frame 30 in the receptacle 12.

Figure 7:
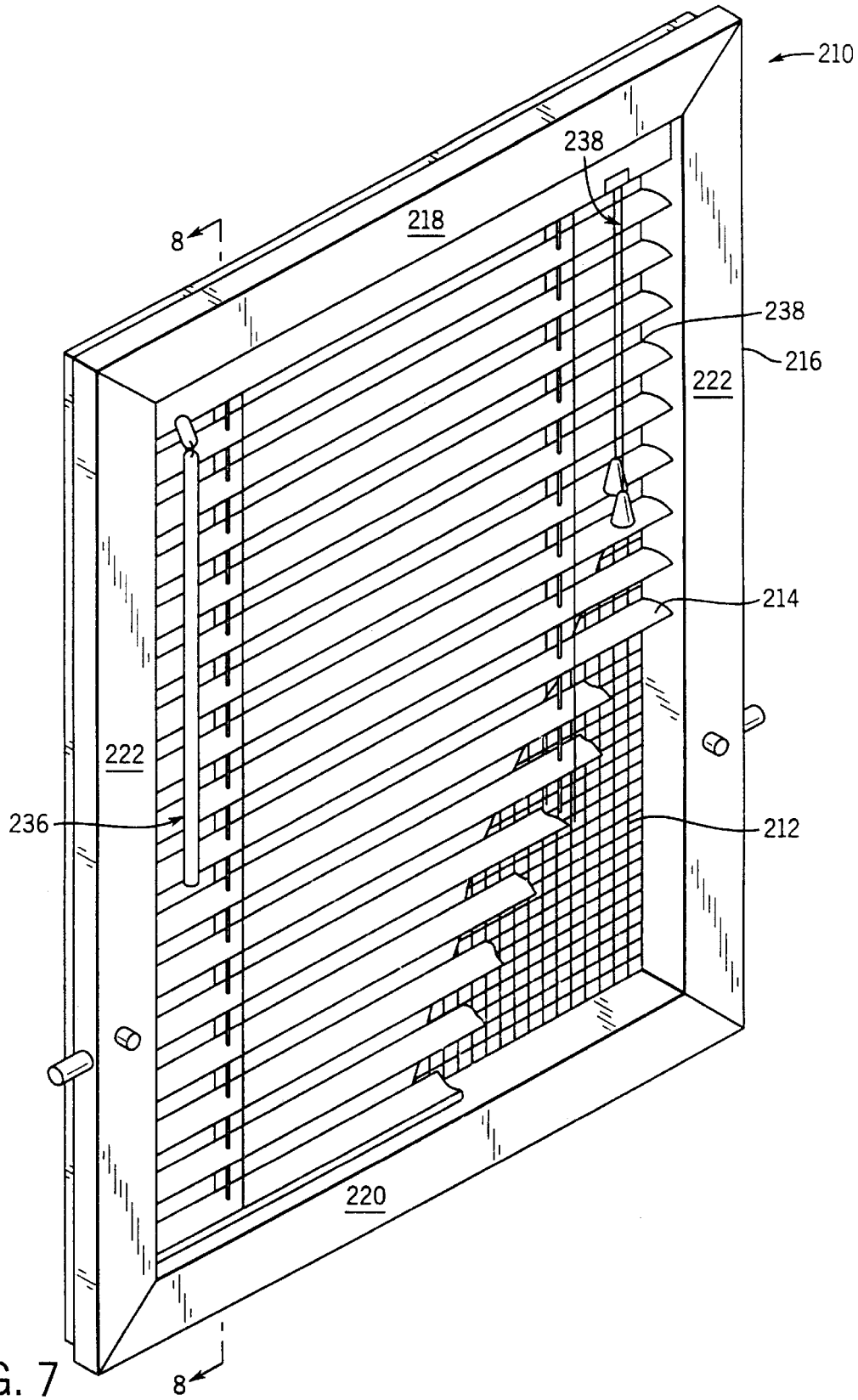
FIG. 7 is a perspective view of a second embodiment of a blind insert incorporating the present invention.
Figure 8:
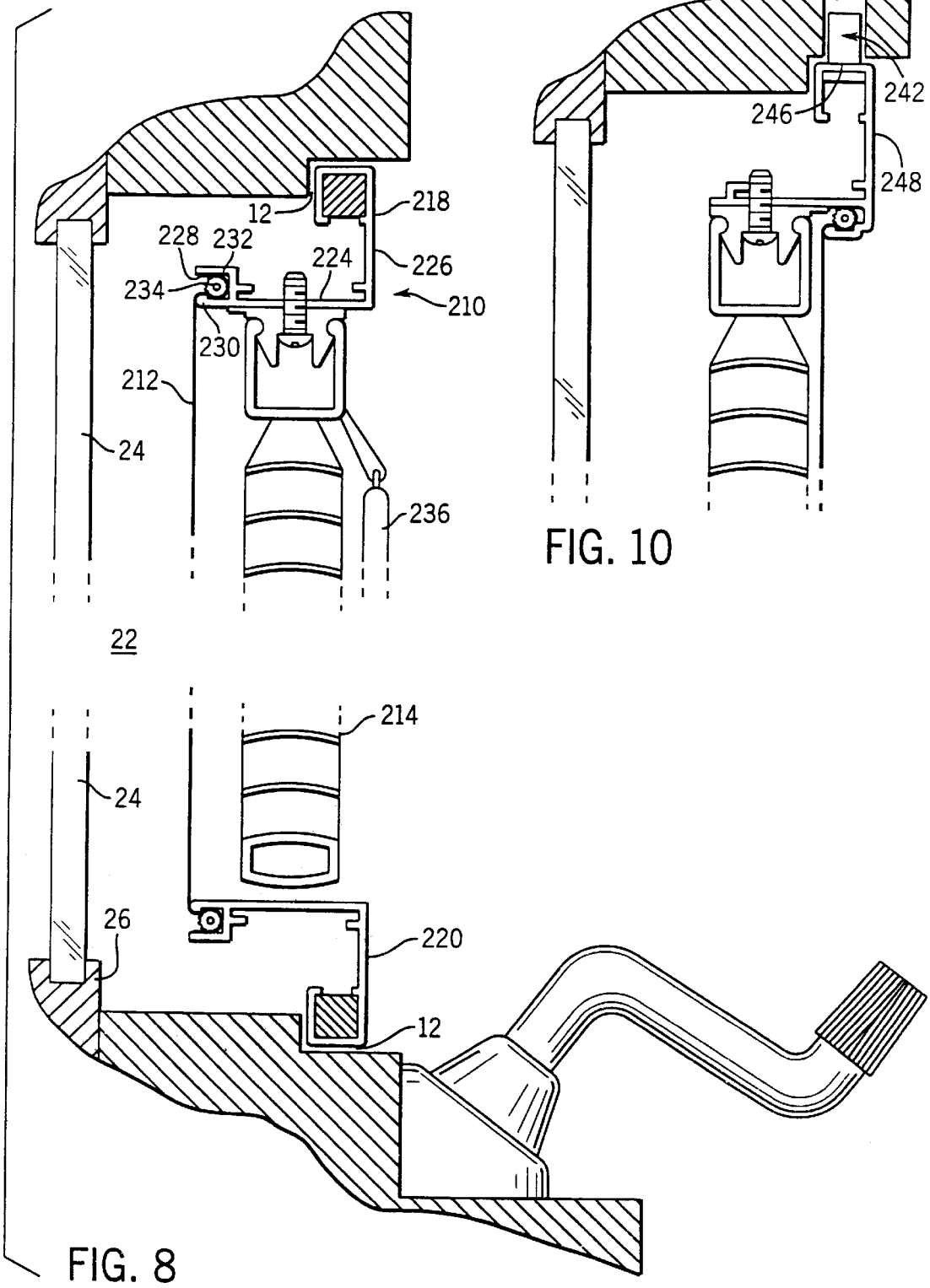
FIG. 8 is a sectional view along line 8—8 of the blind insert of FIG. 7 inserted in an insert receptacle.

In a second embodiment, shown in FIGS. 7 and 8, a blind insert 210 has a screen 212 and blind assembly 214 mounted on a frame 216. When the blind insert 210 is inserted in an insert receptacle 12, such as described above, the screen 212 is interposed between the blind assembly 214 and the window sash 26.

The frame 216 has a top frame member 218, bottom frame member 220, and side frame members 222. As in the first embodiment described above, each frame member 218, 220, and 222 has a substantially identical cross section with a mounting structure 224 extending rearward from a face plate 226. In the second embodiment, however, a spline slot 228 is formed on the mounting structure rearward edge 230 to receive screen edges 232 and a spline 234 for mounting the screen 212.

The second embodiment allows the use of conventional blind tilt control 236 and a blind lift mechanism 238. The blind assembly 214 is mounted to the top frame member mounting structure 224, such as described in the first embodiment. However, with the screen 212 interposed between the blind assembly 214 and window sash 26, the conventional blind tilt control 236 and lift mechanism 238 are easily accessible by a user, eliminating a need for a tilt control knob connected to the blind assembly by a flexible shaft. The blind lift mechanism 238 raises and lowers the blind.

By providing a blind assembly in a frame adapted for use in a conventional window insert receptacle, the blind can be factory assembled and then easily installed by a user without the use of tools. This solves the installation problems of the prior art and allows a user to easily change a window treatment to suit the users needs.

Figure 10:
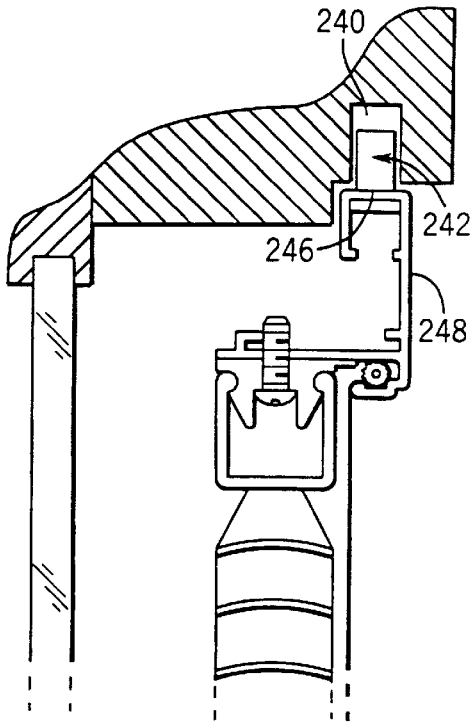
FIG. 10 is a sectional view along line 10—10 of the blind insert of FIG. 9 inserted in an insert receptacle.
Figure 9:
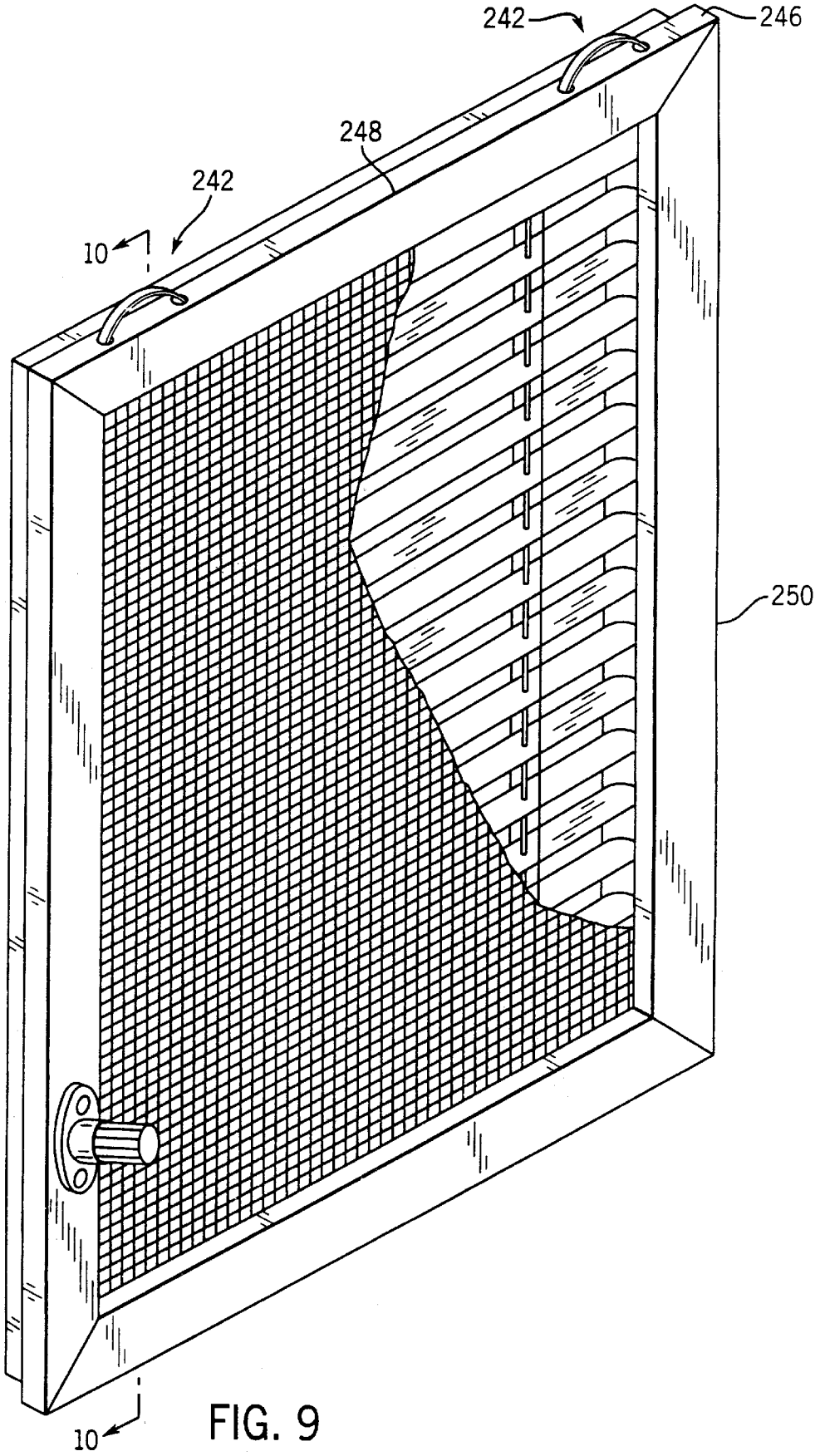
FIG. 9 is a perspective view of a third embodiment of the present invention.

What has been described above is merely the preferred embodiment of the invention. Various changes and modifications can be made therein without departing from the scope of the invention defined by the appended claims. For example, the blind could be replaced with other window treatments such as shades having a translucent material disposed between the slats. The blind assembly could be mounted by its ends to the side member support structures. The blind control mechanism could also be mounted directly to the frame without a headrail. As shown in FIGS. 9 and 10, for insert receptacles having grooves 240, flat tension springs 242 can be mounted to an outer edge 246 of a frame member 248 to hold the frame 250 in the receptacle.

I claim:

1. A window insert suitable for insertion into a window insert receptacle, said insert comprising:

an insert frame defining an opening and adapted for insertion into said window insert receptacle, said insert frame including a top frame member above said opening;

a mounting structure formed as an integral part of said top frame member, said mounting structure having a horizontal mounting surface adjacent said frame opening, and extending from said top frame member substantially perpendicular to a plane defined by said frame opening; and a blind assembly mounted to said horizontal mounting surface.

2. The window insert as in claim 1, further comprising a screen covering said opening, and mounted to said insert frame.

3. The window insert as in claim 1, wherein said insert frame has at least one releasable locking mechanism for releasably locking said insert frame in the insert receptacle.

4. The window insert as in claim 1, including a plurality of horizontal slats depending downwardly from said blind control mechanism, and covering at least a portion of said opening.

5. The window insert as in claim 4, including a bottom rail disposed beneath and connected to said plurality of horizontal slats, said bottom rail being attached to said insert frame.

6. The window insert as in claim 1, in which said insert frame includes said top frame member having top frame member ends;

a pair of side frame members having ends, an end of each of said side frame members joined to a different top frame member end;

a bottom frame member having ends, each end of said bottom member joined to one of said side frame member ends, wherein said joined frame members define said opening.

7. The window insert as in claim 6, including an inwardly opening spline slot formed in said insert frame for mounting a screen.

8. The window insert as in claim 1, in which said blind assembly has a width, and said mounting surface extends rearwardly from said top frame member at least a distance equal to said width.

9. A window frame insert suitable for use with a blind assembly including a headrail having a width, the frame insert comprising:

a top frame member having ends;

a pair of side frame members having ends, an end of each of said side frame members joined to a different top frame member ends; and a bottom frame member having ends, each end of said bottom member joined to one of said side frame member ends, wherein said joined frame members define a frame perimeter and a frame opening;

a hortizontal mounting structure formed as an integral part of said top frame member, said horizontal mounting structure having a horizontal surface for mounting a blind assembly thereto, said surface being adjacent said frame opening, and extending from said top frame member substantially perpendicular to a plane defined by said frame opening;

wherein at least one of said frame members has a biasing retention member for releasably retaining said frame in an insert receptacle.

10. The window frame insert as in claim 9, wherein said mounting surface extends rearward from said top frame member at least a distance equal to the headrail width.

11. The window frame insert as in claim 9, including an inwardly opening spline slot formed in said insert frame for mounting a screen.

* * * * *